US006433322B2

(12) United States Patent
Zeng et al.

(10) Patent No.: US 6,433,322 B2
(45) Date of Patent: Aug. 13, 2002

(54) ABUSE-TOLERANT METALLIC PACKAGING MATERIALS FOR MICROWAVE COOKING

(75) Inventors: Neilson Zeng, Toronto; Laurence Lai, Mississauga; Anthony Russell, Rockwood, all of (CA)

(73) Assignee: Graphic Packaging Corporation, Golden, CO (US)

( * ) Notice: Subject to any disclaimer, the term of this patent is extended or adjusted under 35 U.S.C. 154(b) by 0 days.

(21) Appl. No.: 09/765,851

(22) Filed: Jan. 19, 2001

Related U.S. Application Data

(63) Continuation-in-part of application No. 09/399,182, filed on Sep. 20, 1999, now Pat. No. 6,204,492.

(51) Int. Cl.[7] ..... H05B 6/80

(52) U.S. Cl. ..... 219/728; 219/745; 426/107

(58) Field of Search ..... 219/725, 728, 219/730, 734, 745, 759, 729; 426/107, 234, 243; 99/DIG. 14

(56) References Cited

U.S. PATENT DOCUMENTS

| | | | | |
|---|---|---|---|---|
| 4,398,994 A | | 8/1983 | Beckett | |
| 4,552,614 A | | 11/1985 | Beckett | |
| 4,656,325 A | * | 4/1987 | Keefer | 219/728 |
| 5,117,078 A | | 5/1992 | Beckett | |
| 5,266,386 A | | 11/1993 | Beckett | |
| 5,310,976 A | | 5/1994 | Beckett | |
| 5,340,436 A | | 8/1994 | Beckett | |
| 5,354,973 A | | 10/1994 | Beckett | |
| 5,446,270 A | | 8/1995 | Chamberlain et al. | |
| 5,530,231 A | | 6/1996 | Walters et al. | |
| 5,698,127 A | | 12/1997 | Lai et al. | |
| 5,928,555 A | * | 7/1999 | Kim et al. | 219/729 |
| 6,049,072 A | | 4/2000 | Olson et al. | |
| 6,204,492 B1 | * | 3/2001 | Zeng et al. | 219/728 |
| 6,251,451 B1 | * | 6/2001 | Zeng | 426/107 |

FOREIGN PATENT DOCUMENTS

| | | |
|---|---|---|
| CA | 2196154 | 7/1998 |
| WO | WO 98/33724 | 8/1998 |
| WO | WO 98/35887 | 8/1998 |

* cited by examiner

*Primary Examiner*—Tu Ba Hoang
(74) *Attorney, Agent, or Firm*—Dorsey & Whitney LLP

(57) ABSTRACT

An abuse-tolerant microwave food packaging material includes repeated sets of metallic foil or high optical density evaporated material segments disposed on a substrate. Each set of metallic segments is arranged to define a perimeter having a length equal to a predetermined fraction of the operating or effective wavelength of an operating microwave oven. The repeated sets of segments act both as a shield to microwave energy and as focusing elements for microwave energy when used in conjunction with food products, while remaining electrically safe in the absence of the food products.

12 Claims, 7 Drawing Sheets

ABUSE-TOLERANT METALLIC PACKAGING MATERIALS FOR MICROWAVE COOKING

CROSS REFERENCE TO RELATED APPLICATIONS

This application is a continuation-in-part of U.S. application Ser. No. 09/399,182 filed Sep. 20, 1999, now U.S. Pat. No. 6,204,492 and claims the benefit of the filing date thereof.

BACKGROUND OF THE INVENTION

1. Field of the Invention

The present invention relates to an improved microwave-interactive cooking package. In particular, the present invention relates to high efficiency, safe and abuse-tolerant susceptor and foil materials for packaging and cooking microwavable food.

2. Description of the Related Art

Although microwave ovens have become extremely popular, they are still seen as having less than ideal cooking characteristics. For example, food cooked in a microwave oven generally does not exhibit the texture, browning, or crispness that are acquired when food is cooked in a conventional oven.

A good deal of work has been done in creating materials or utensils that permit food to be cooked in a microwave oven to obtain cooking results similar to that of conventional ovens. The most popular device being used at present is a plain susceptor material, which is an extremely thin (generally 60 to 100 Å) metallized film that heats under the influence of a microwave field. Various plain susceptors (typically aluminum, but many variants exist) and various patterned susceptors (including square matrix, "shower flower", hexagonal, slot matrix and "fuse" structures) are generally safe for microwave cooking. However, susceptors do not have a strong ability to modify a non-uniform microwave heating pattern in food through shielding and redistributing microwave power. The quasi-continuous electrical nature of these materials prevents large induced currents (so limiting their power reflection capabilities) or high electromagnetic (E-field) strengths along their boundaries or edges. Therefore their ability to obtain uniform cooking results in a microwave oven is quite limited.

Electrically "thick" metallic materials (e.g., foil materials) have also been used for enhancing the shielding and heating of food cooked in a microwave oven. Foil materials are much thicker layers of metal than the thin, metallized films of susceptors. Foil materials, also often aluminum, are quite effective in the prevention of local overheating or hot spots in food cooked in a microwave by redistributing the heating effect and creating surface browning and crisping in the food cooked with microwave energy. However, many designs fail to meet the normal consumer safety requirements by either causing fires, or creating arcing as a result of improper design or misuse of the material.

The reason for such safety problems is that any bulk metallic substance can carry very high induced electric currents in opposition to an applied high electromagnetic field under microwave oven cooking. This results in the potential for very high induced electromagnetic field strengths across any current discontinuity (e.g., across open circuit joints or between the package and the wall of the oven). The larger the size of the bulk metallic materials used in the package, the higher the potential induced current and induced voltage generated along the periphery of the metallic substance metal. The applied E-field strength in a domestic microwave oven might be as high as 15 kV/m under no load or light load operation. The threat of voltage breakdown in the substrates of food packages as well as the threat of overheating due to localized high current density may cause various safety failures. These concerns limit the commercialization of bulk foil materials in food packaging.

Commonly owned Canadian Patent No. 2196154 offers a means of avoiding abuse risks with aluminum foil patterns. The structure disclosed addresses the problems associated with bulk foil materials by reducing the physical size of each metallic element in the material. Neither voltage breakdown, nor current overheat will occur with this structure in most microwave ovens, even under abuse cooking conditions. Abuse cooking conditions can include any use of a material contrary to its intended purpose including cooking with cut or folded material, or cooking without the intended food load on the material. In addition, the heating effectiveness of these metallic materials is maximized through dielectric loading of the gaps between each small element that causes the foil pattern to act as a resonant loop (albeit at a much lower Q-factor (quality factor) than the solid loop). These foil patterns were effective for surface heating. However, it was not recognized that a properly designed metallic strip pattern could also act to effectively shield microwave energy to further promote uniform cooking.

Commonly owned U.S. Pat. No. 6,133,560 approaches the problem differently by creating low Q-factor resonant circuits by patterning a susceptor substrate. The low Q-factor operation described in U.S. Pat. No. 6,133,560 provides only a limited degree of power balancing.

SUMMARY OF THE INVENTION

The present invention relates to an abuse-tolerant microwave packaging material which both shields food from microwave energy to control the occurrence of localized overheating in food cooked in a microwave, and focuses microwave energy to an adjacent food surface.

Abuse-tolerant packaging according to the present invention includes one or more sets of continuously repeated microwave-interactive metallic segments disposed on a microwave-safe substrate. Each set of metallic segments defines a perimeter equal to a predetermined fraction of the effective wavelength in an operating microwave oven. Methodologies for choosing such predetermined fractional wavelengths are discussed in U.S. Pat. No. 5,910,268, which is incorporated herein by reference. The metallic segments can be foil segments, or may be segments of a high optical density evaporated material deposited on the substrate. The terms "fraction" or "fractional" as used herein are meant in their broadest sense as the numerical representation of the quotient of two numbers, i.e., the terms include values of greater than, equal to, and less than one (1).

In a first embodiment, the length of the perimeter defined by a first set of metallic segments is preferably approximately equal to an integer multiple of the effective wavelength of microwaves in an operating microwave oven, such that the length of the perimeter is resonant with the effective wavelength. In a second embodiment, the length of the perimeter defined by the metallic segments is approximately equal to an integer multiple of one-half the effective wavelength of microwaves in an operating microwave oven, such that the length of the second perimeter is quasi-resonant with the effective wavelength.

Each segment in the first set is spaced from adjacent segments so as to create a (DC) electrical discontinuity between the segments. Preferably, each first set of metallic segments defines a five-lobed flower shape. The five-lobed flower shape promotes uniform distribution of microwave energy to adjacent food by distributing energy from its perimeter to its center.

Preferably, abuse-tolerant packaging according to the present invention includes a repeated second set of spaced metallic segments that enclose each first set of metallic segments and define a second perimeter. In the first embodiment, this second perimeter preferably has a length approximately equal to an integer multiple of the effective wavelength of microwaves in an operating microwave oven, such that the length of the second perimeter is resonant with the effective wavelength. In the second embodiment, this second perimeter preferably has a length approximately equal to an integer multiple of one-half the effective wavelength of microwaves in an operating microwave oven, such that the length of the second perimeter is quasi-resonant with the effective wavelength.

A third embodiment of abuse-tolerant packaging according to the present invention includes, in addition to the second set of metallic segments, a repeated third set of spaced metallic segments that enclose each second set of metallic segments and define a perimeter approximately equal to another predetermined fraction of the effective wavelength of microwaves in an operating microwave oven.

DETAILED DESCRIPTION OF THE INVENTION

Figure 1:
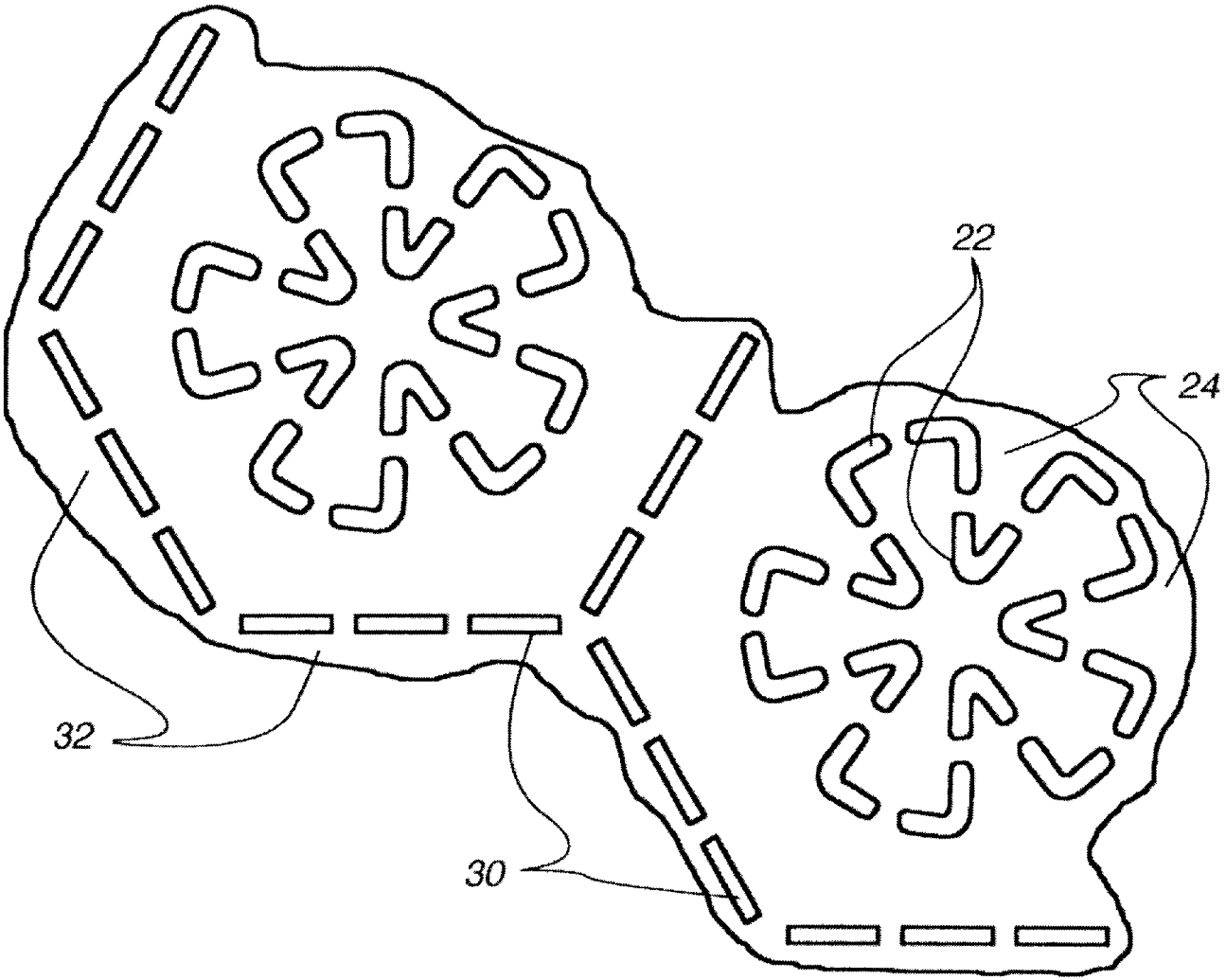
FIG. 1 is a detail view of a portion of a sheet of abuse-tolerant microwave packaging material incorporating a repeated pattern of reflective segments according to a first embodiment of the present invention.

For a better understanding of the invention, the following detailed description refers to the accompanying drawings, wherein preferred exemplary embodiments of the present invention are illustrated and described.

The present invention relates to an abuse-tolerant, high heating-efficiency metallic material used in microwave packaging materials. This abuse-tolerant material redistributes incident microwave energy so as to increase reflection of microwave energy while maintaining high microwave energy absorption. A repeated pattern of metallic foil segments can shield microwave energy almost as effectively as a continuous bulk foil material while still absorbing and focusing microwave energy on an adjacent food surface. The metallic segments can be made of foil or high optical density evaporated materials deposited on a substrate. High optical density materials include evaporated metallic films that have an optical density greater than one (optical density being derived from the ratio of light reflected to light transmitted). High optical density materials generally have a shiny appearance, whereas thinner metallic materials, such as susceptor films have a flat, opaque appearance. Preferably, the metallic segments are foil segments.

The segmented foil (or high optical density material) structure prevents large induced currents from building at the edges of the material or around tears or cuts in the material, thus diminishing the occurrences of arcing, charring, or fires caused by large induced currents and voltages. The present invention includes a repeated pattern of small metallic segments, wherein each segment acts as a heating element when under the influence of microwave energy. In the absence of a dielectric load (i.e., food), this energy generates only a small induced current in each element and hence a very low electric field strength close to its surface.

Preferably, the power reflection of the abuse-tolerant material is increased by combining the material in accordance with the present invention with a layer of conventional susceptor film. In this configuration, a high surface heating environment is created through the additional excitement of the susceptor film due to the composite action of food contacting the small metallic segments. When the food contacts the metallic segments of the abuse-tolerant material according to the present invention, the quasi-resonant characteristic of perimeters defined by the metallic segments can stimulate stronger and more uniform cooking. Unlike a full sheet of plain susceptor material, the present invention can stimulate uniform heating between the edge and center portion of a sheet of the abuse-tolerant metallic material to achieve a more uniform heating effect. The average width and perimeter of the pattern of metallic segments will determine the effective heating strength of the pattern and the degree of abuse tolerance of the pattern. However, the power transmittance directly toward the food load through an abuse-tolerant metallic material according to the present invention is dramatically decreased, which leads to a quasi-shielding functionality. In the absence of food contacting the material, according to the present invention, the array effect of the small metallic segments still maintains a generally transparent characteristic with respect to microwave power radiation. Thus, the chances of arcing or burning when the material is unloaded or improperly loaded are diminished.

Preferably, each metallic segment has an area less than 5 $mm^2$ and the gap between each small metallic strip is larger than 1 mm. Metallic segments of such size and arrangement reduce the threat of arcing that exists under no load conditions in average microwave ovens. When, for example, food, a glass tray, or a layer of plain susceptor film contacts the metallic segments, the capacitance between adjacent metallic segments will be raised as each of these substances has a dielectric constant much larger than a typical substrate on which the small metal segments are located. Of these materials, food has the highest dielectric constant (often by an order of magnitude). This creates a continuity effect of connected metallic segments which then work as a low Q-factor resonate loop, power transmission line, or power reflection sheet with the same function of many designs that would otherwise be unable to withstand abuse conditions. On the other hand, the pattern is detuned from the resonant characteristic in the absence of food. This selectively tuned effect substantially equalizes the heating capability over a fairly large packaging material surface including areas with and without food.

Note, the effective wavelength, $\lambda_{eff}$, of microwaves in a dielectric material (e.g., food products) is calculated by the formula $$\lambda_{eff} = \frac{\lambda_o}{\sqrt{\varepsilon}},$$

where $\lambda_0$ is the wavelength of microwaves in air and $\epsilon$ is the dielectric constant of the dielectric material. According to the present invention, the perimeter of each set of metallic segments is preferably a predetermined fraction of the effective wavelength of microwaves in an operating microwave oven. The predetermined fraction is selected based on the properties of the food to be cooked, including the dielectric constant of the food and the amount of bulk heating desired for the intended food. For example, a perimeter of a set of segments can be selected to be equal to predetermined fractions or multiples of the effective microwave wavelength for a particular food product. Furthermore, a resonant fraction or multiple of the microwave wavelength is selected when the microwave packaging material is to be used to cook a food requiring strong heating, and a smaller, high density, nested perimeter of a quasi-resonant, fractional wavelength is selected when the microwave packaging material is used to cook food requiring less heating, but more shielding. Therefore, the benefit of concentric but slightly dissimilar perimeters is to provide good overall cooking performance across a greater range of food properties (e.g., from frozen to thawed food products).

Figure 3:
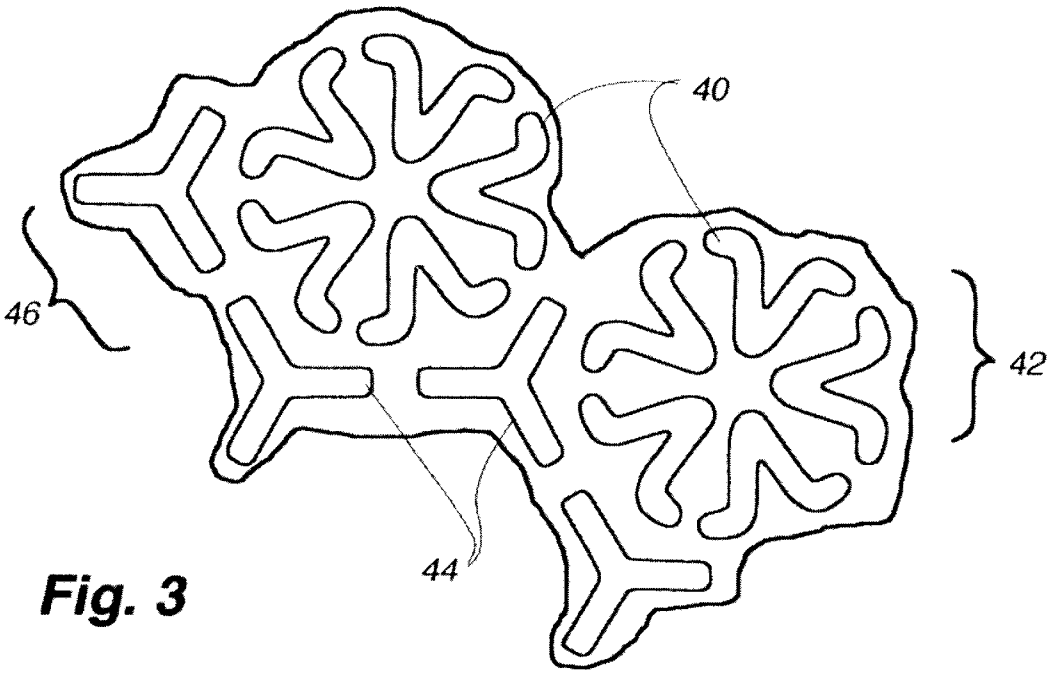
FIG. 3 is a detail view of a portion of a sheet of abuse-tolerant microwave packaging material incorporating a repeated pattern of reflective segments according to a second embodiment of the present invention.
Figure 4:
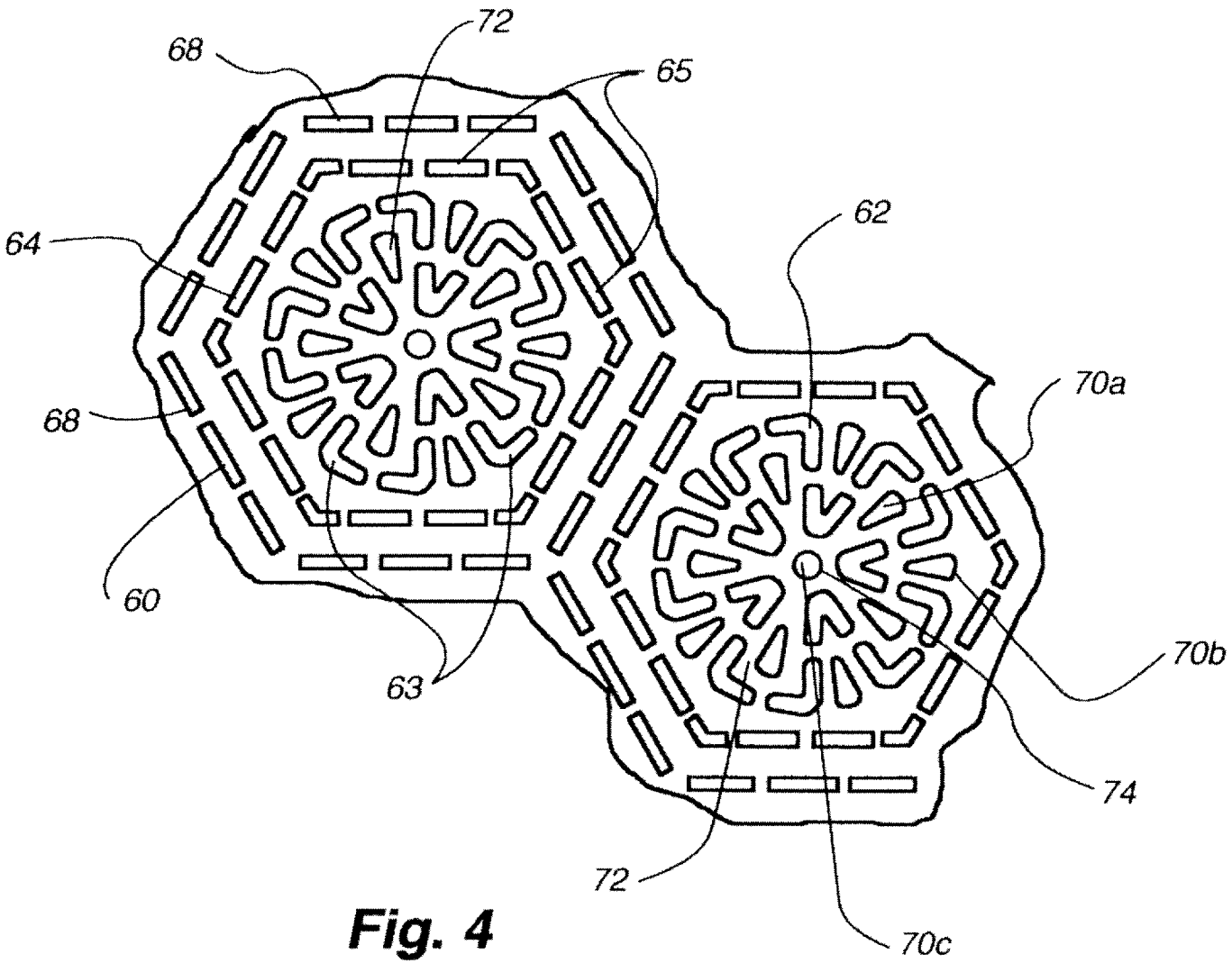
FIG. 4 is a detail view of a portion of a sheet of abuse-tolerant microwave packaging material incorporating repeated pattern of reflective segments according to a third embodiment of the present invention.

Turning to the drawing figures, FIGS. 1, 3, and 4 show three respective embodiments of patterns of metallic foil segments according to the present invention. In a first embodiment in accordance with the present invention shown in FIG. 1, a first set of spaced bent metallic segments 22 define a first perimeter, or loop, 24. According to the present invention, the length of the first perimeter 24 is preferably approximately equal to an integer multiple of the effective wavelength of microwaves in a microwave oven, such that the length of the first perimeter 24 is resonant with the effective wavelength. The length of the first perimeter 24 of the first set of metallic segments 22 may be other fractions of the effective wavelength depending upon the food product and the desired cooking result. In a preferred first embodiment, the first perimeter 24 is approximately equal to one full effective wavelength of microwaves in an operating microwave oven.

Preferably the first set of metallic segments 22 are arranged to define a five-lobed flower shape as the first perimeter 24, as seen in each of the respective embodiments shown in FIGS. 1, 3, and 4. The five-lobed flower arrangement promotes the even distribution of microwave energy to adjacent food. Metallic segments 22 defining other shapes for the first perimeter or loop 24 such as circles, ovals, and other curvilinear shapes, preferably symmetrical curvilinear shapes, triangles, squares, rectangles, and polygonal shapes, preferably right polygons, and even more preferably equilateral polygonal shapes, are within the scope of the present invention.

As used herein the term "symmetrical curvilinear shape" means a closed curvilinear shape that can be divided in half such that the two halves are symmetrical about an axis dividing them. As used herein, the term "right polygon" means a polygon that can be divided in half such that the two halves are symmetrical about an axis dividing them. Equilateral polygons would therefore be a subset of right polygons. It should be remembered that all of these shapes, which are closed by definition, are merely patterns that the sets of metallic segments follow, but the metallic segments themselves are not connected and are therefore not closed.

Preferably, each first set of metallic segments 22 is accompanied by an enclosing second set of straight metallic segments 30. The second set of metallic segments 30 also preferably defines a second perimeter 32 preferably having a length approximately equal to an integer multiple of the effective wavelength of microwaves in an operating microwave oven, such that the length of the second perimeter 32 is resonant with the effective wavelength. The length of the second perimeter 32 of the second set of metallic segments 30 may be other fractions of the effective wavelength depending upon the food product and the desired cooking result.

The first and second sets of metallic segments 22, 30 are arranged to define a pattern (only partially shown in FIG. 1, but fully shown in FIG. 5, which is described later), which is continuously repeated to create a desired quasi-shielding effect. Preferably, the second set of metallic segments 30 (the outer set of segments in the first embodiment) define a hexagonal second perimeter 32, a shape that allows each second set of metallic segments 30 to be nested with adjacent second sets of metallic segments 30. Nested arrays of resonant hexagonal loops are described in commonly owned U.S. Pat. No. 6,133,560 and are discussed in more detail in reference to FIG. 5. The hexagon is an excellent basic polygon to select due to its ability to nest perfectly along with its high degree of cylindrical symmetry.

Other shapes that can be used to define the second perimeter 32, and that are within the scope of this invention, include circles, ovals, and other curvilinear shapes, preferably symmetrical curvilinear shapes, triangles, squares, rectangles, and other polygonal shapes, preferably right polygonal shapes, and even more preferably equilateral polygonal shapes. These shapes are preferably configured in arrays such that they are similarly capable of nesting. In addition, the arrays of shapes defining the second perimeter 32 need not be repetitive of a single shape, but instead can be combinations of various shapes, preferably capable of nesting. For example, an array of shapes defining the second perimeter 32 might be an array of nested hexagons and polygons, as in the patchwork of a soccer ball.

Figure 2:
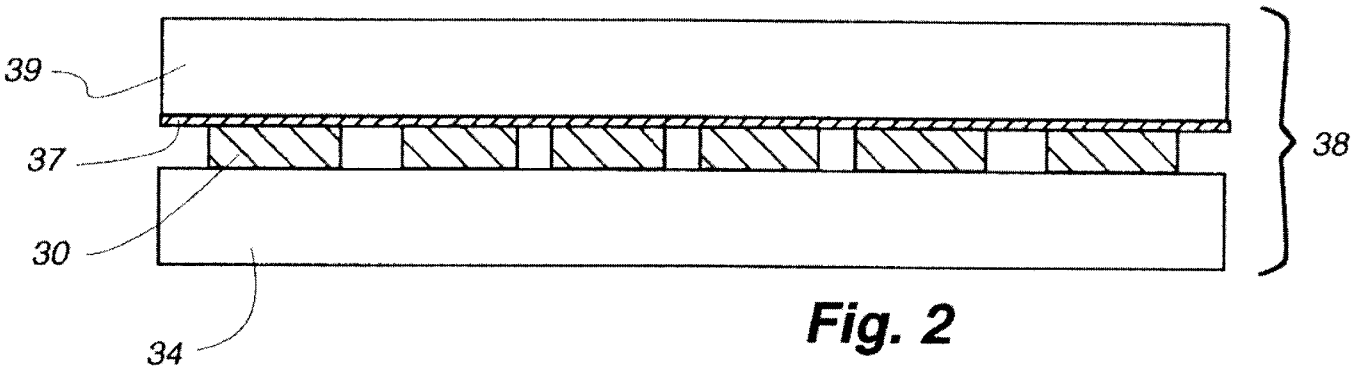
FIG. 2 is a sectional view of abuse-tolerant packaging material according to the present invention.

The first and second sets of metallic segments 24, 30 are preferably formed on a microwave transparent substrate 34, as shown in FIG. 2, by conventional techniques known in the art. One technique involves selective demetalization of aluminum having a foil thickness and which has been laminated to a polymeric film. Such demetalizing procedures are described in commonly assigned U.S. Pat. Nos. 4,398,994, 4,552,614, 5,310,976, 5,266,386 and 5,340,436, the disclosures of which are incorporated herein by reference. Alternately, metallic segments may be formed on a susceptor film (i.e., a metallized polymeric film) using the same techniques. Segments of high optical density evaporated materials can be produced by similar etching techniques or by evaporating the material onto a masked surface to achieve the desired pattern. Both techniques are well known in the art. FIG. 2 shows a schematic sectional view of metallic segments 30 formed on a substrate 34 and including a susceptor film 36 having a metallized layer 37 and a polymer layer 39 to form a microwave packaging material 38 according to the present invention.

In a second embodiment shown in FIG. 3, a first set of bent metallic segments 40 define a first perimeter 42, preferably having a length equal to an integer multiple of one-half an effective wavelength (i.e., 0.5λ, 1λ, 1.5λ, etc.) of microwaves in an operating microwave oven. Like the first embodiment, the first perimeter 42 preferably defines a multi-lobed shape in order to evenly distribute microwave energy. Also as in the first embodiment, the first perimeter 42 may define various other shapes as described above. The smaller, more densely nested, first perimeter 42 pattern shown in FIG. 3 has a higher reflection effect under light or no loading than the larger first perimeter 24 pattern shown in FIG. 1, at the expense of a proportionate amount of microwave energy absorption and heating power. A second set of metallic segments 44 encloses the first set of metallic segments 40 in the second embodiment, and defines a second perimeter 46, preferably of a length approximately equal to an integer multiple of one-half the effective wavelength of microwaves in an operating microwave oven. Preferably, the second set of metallic segments 44 are arranged in a nested configuration and define a hexagonal second perimeter. Again, the second perimeter 46 may be configured in many other arrays of shapes and combinations thereof as described above with reference to the first embodiment.

A third embodiment of a pattern of metallic segments, in accordance with the present invention, is shown in FIG. 4. The third embodiment includes a third set of metallic segments 60 in addition to first and second sets of metallic segments 62, 64 defining first and second perimeters 63, 65 similar to those in the first embodiment. The third set of metallic segments 60 encloses the second set of metallic segments 64 and defines a third perimeter 68. Preferably, in the pattern according to the third embodiment shown in FIGS. 4 and 5, the second set of metallic segments 64 defines the second perimeter 65 with a length approximately equal to an integer multiple of the effective wavelength of microwaves in an operating microwave oven, such that the length of the second perimeter 65 is resonant with the effective wavelength. The third set of metallic segments 60 then defines the third perimeter 68, preferably with a similar, but deliberately altered, perimeter length approximately equal to a predetermined fraction of the effective wavelength of microwaves in an operating microwave oven.

Preferably the third set of metallic segments 60 defines a hexagonal third perimeter 68. However, other shapes can be used to define the third perimeter 68 and include circles, ovals, and other curvilinear shapes, preferably symmetrical curvilinear shapes, triangles, squares, rectangles, and other polygonal shapes, preferably right polygonal shapes, and even more preferably equilateral polygonal shapes. These shapes are preferably configured in arrays such that they are similarly capable of nesting. In addition, the arrays of shapes defining the third perimeter 68 need not be repetitive of a single shape, but instead can be combinations of various shapes, preferably capable of nesting. For example, an array of shapes defining the second perimeter might be an array of nested hexagons and polygons, as in the patchwork of a soccer ball.

In the third embodiment, additional metallic segments 70*a*, 70*b*, and 70*c* are preferably included within each lobe 72 (70*a*), between each lobe 72 (70*b*), and at a center 74 (70*c*) of the five-lobed flower shape defined by the first set of metallic segments 62. The additional metallic segments 70*a* and 70*b* that are arranged between and within the lobes 72 are preferably triangular shaped with vertices pointing in the direction of the center 74 of the flower shape. The additional segments 70*a*, 70*b*, and 70*c* further enhance the even distribution of microwave energy, in particular from the edges of the perimeter to the center of the perimeter.

Figure 5:
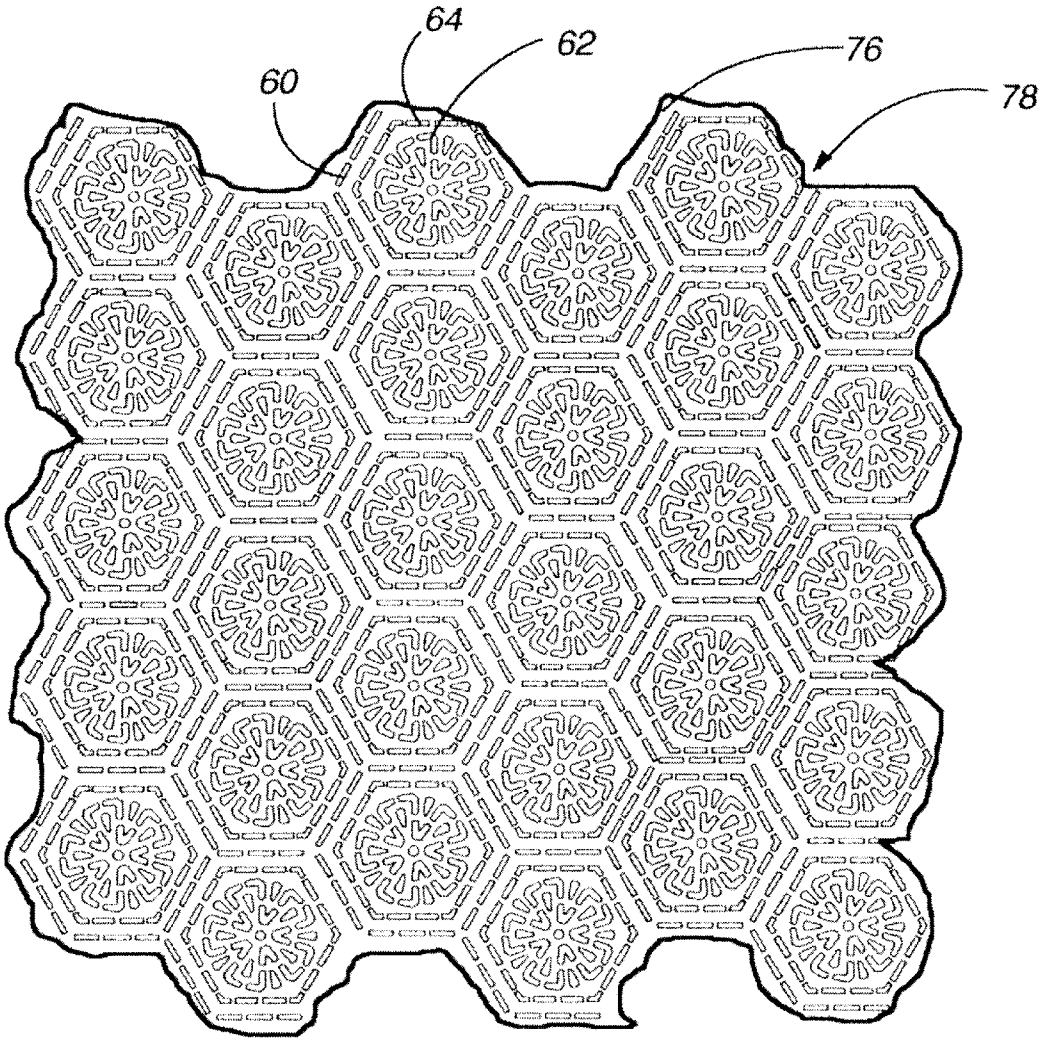
FIG. 5 is a detail view of a portion of a sheet of abuse-tolerant microwave packaging material according to the third embodiment of the present invention.

Similar to the first embodiment, first and second sets of metallic segments 40, 44 in the second embodiment, and first, second, and third sets of metallic segments 62, 64, 60 in the third embodiment are preferably formed on a microwave transparent substrate in the same manner as discussed herein with reference to FIG. 2. An example of a sheet of microwave packaging material according to the present invention is shown in FIG. 5. A pattern according to the third embodiment shown in FIG. 4 is repeated on a substrate 76 which may be microwave transparent (e.g., paperboard), or include a susceptor film. Preferably, the third set of metallic segments 60 is repeated with the first and second sets of metallic segments 62, 64 in a nested array 78 best seen in FIG. 5. A nested array 78 is an arrangement wherein each of the metallic segments in an outer set of metallic segments is shared by adjacent sets of metallic segments (i.e., one strip of metallic segments divides one first or second set of segments from another first or second set). The nested array 78 contributes to the continuity of the overall pattern and therefore to the quasi-shielding effect of the present invention. Furthermore, outer sets of metallic segments are preferably arranged to define a hexagonal shape to better facilitate a nested array 78 of sets of metallic segments.

Further advantages and features of the present invention are discussed in the context of the following examples.

EXAMPLE 1

Figure 7:
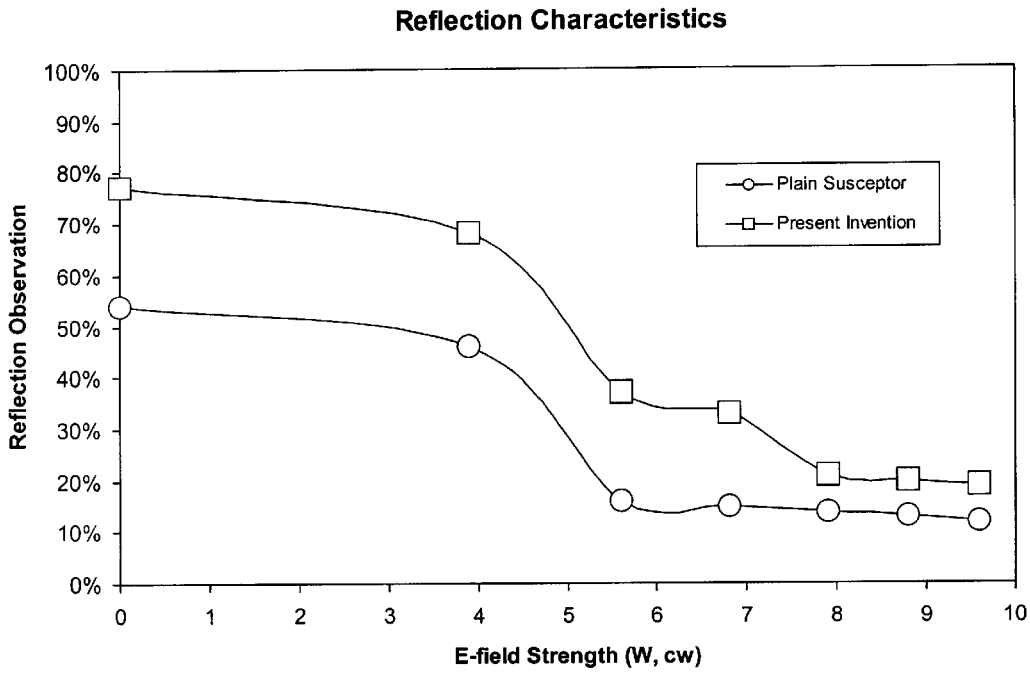
FIG. 7 is a graph comparing the power reflection characteristics of a plain susceptor material to the abuse-tolerant microwave packaging material of the present invention.

In Example 1, the power Reflection/Absorption/Transmission (RAT) characteristics of plain susceptor paper and arrays of metallic segments formed on susceptor paper according to the present invention are compared. The metallic segments were arranged in a nested pattern according to the second and third embodiments shown in FIGS. 3 and 4. Both were measured using a microwave Network Analyzer (NWA), which is an instrument commonly used in the art for measuring microwave device characteristics at low power levels. Tests were also operation. The table below and graph as shown in FIG. 7 show that a susceptor including a nested conducted in a high power test set with a wave guide type WR430 under open load operation. The table below and graph shown in FIG. 7 show that a susceptor including a nested segmented foil pattern as shown in FIG. 3 performed at a higher power reflection capacity than the plain susceptor at an E-field strength of 6 kV/m under an open load. The power reflection for a plain susceptor reaches 54% at low E-field strength radiation and 16% at high E-field strength radiation. Power reflection of a susceptor laminated to arrays of metallic segments according to the present invention susceptor provides 77% reflection at low E-field radiation and 34% at high E-field radiation. The table below and graph in FIG. 7 demonstrate that a microwave packaging material including a repeated pattern of metallic segments according to the present invention has much improved shielding characteristics compared to plain susceptor material.

| Applied Electric Field (kV/m) | Plain Suceptor Transmission | Reflection | Absorption | Present Invention Transmission | Reflection | Absorption |
|---|---|---|---|---|---|---|
| 0.0 | 6% | 54% | 40% | 1% | 77% | 21% |
| 3.9 | 14% | 46% | 40% | 4% | 68% | 28% |
| 5.6 | 50% | 16% | 34% | 40% | 37% | 26% |
| 6.8 | 57% | 15% | 29% | 45% | 33% | 21% |
| 7.9 | 66% | 14% | 21% | 69% | 21% | 11% |
| 8.8 | 65% | 13% | 22% | 67% | 20% | 14% |
| 9.6 | 66% | 12% | 22% | 67% | 19% | 14% |

EXAMPLE 2

Figure 8:
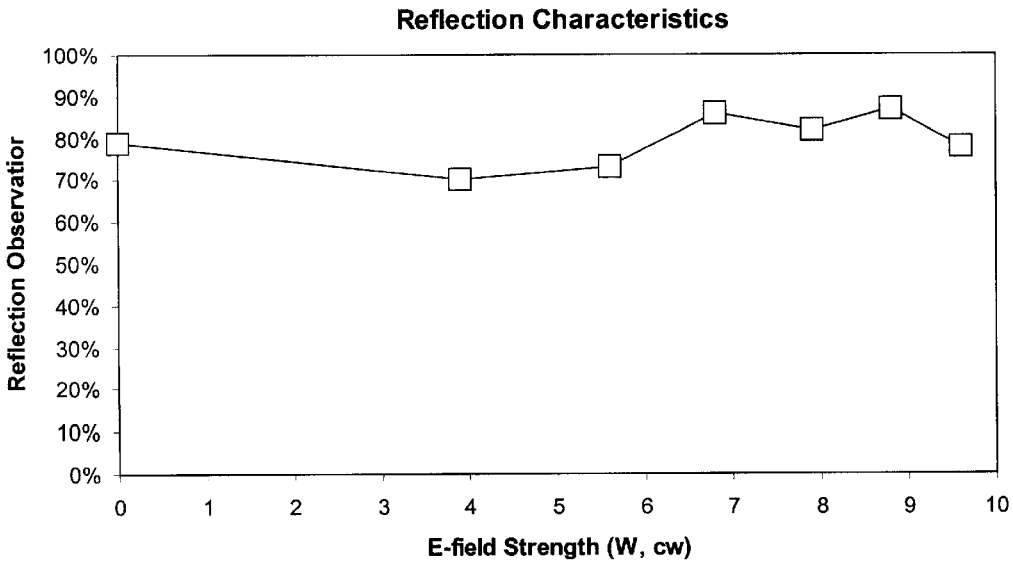
FIG. 8 is a graph showing the power reflection characteristics of the abuse-tolerant microwave packaging material of FIGS. 4 and 5.

Example 2 shows RAT performance of the third embodiment of the present invention (FIGS. 4 and 5) laminated on a susceptor. The measurements were taken with a layer of pastry in contact with the packaging material according to the present invention. The quasi-resonance and power reflection effect occurs when the food is in contact with the metallic segments so as to complete the segmented pattern. FIG. 8 shows the power reflection of the present invention to be between 73% to 79% under normal microwave operating conditions. (It is assumed that plain bulk metallic foil has a power reflection of 100%.) This test demonstrates that the present invention can be used as a quasi-shielding material in microwave food packaging. The benefit of the present invention is that, unlike bulk metallic foil, it is abuse-tolerant and safe for microwave oven cooking, yet still has much of the shielding effect of bulk metallic foil when loaded with food (even under the very high stress conditions of this test).

| Applied Electric Field (kV/m) | Present Invention Transmission | Reflection | Absorption |
|---|---|---|---|
| 0.0 | 1% | 79% | 20% |
| 3.9 | 4% | 70% | 26% |
| 5.6 | 4% | 73% | 23% |
| 6.8 | 4% | 86% | 10% |
| 7.9 | 4% | 82% | 15% |
| 8.8 | 12% | 87% | 1% |
| 9.6 | 21% | 78% | 1% |

EXAMPLE 3

Figure 9:
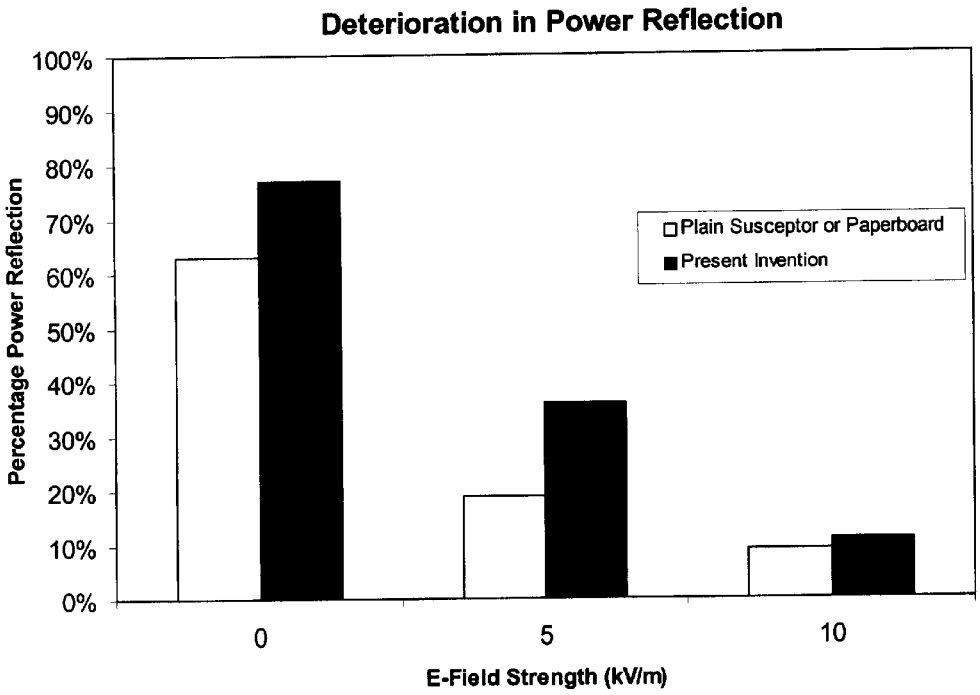
FIG. 9 is a graph comparing the the deterioration in power reflection over time of plain susceptor material to the abuse-tolerant microwave packaging material of the present invention.

Example 3 shows the stability of the power reflection performance of both a plain susceptor and the microwave packaging material according to the third embodiment (FIGS. 4 and 5) of the present invention laminated to a susceptor under increasing E-field strengths in open load operation. RAT characteristic data of each material was measured after two minutes of continuous radiation in each level of E-field field strength as shown in the table below. The graph shwon in FIG. 9 indicates the matallic segment/susceptor laminate material is also more durable than the plain susceptor. While not wishing to be bound by one particular theory, the inventors presently believe that the increased durability of the present invention results from the metallic segments imparting mechanical stability to the polymer layer commonly included in susceptor films.

| Packaging | E-Field Strength | Reflection | Trans-mission | Ab-sorption | Film Appearance |
|---|---|---|---|---|---|
| Plain Susceptor or PaperBoard | 0 | 63% | 4% | 33% | no crack |
| Plain Susceptor or PaperBoard | 5 | 19% | 52% | 28% | visible crack |
| Plain Susceptor or PaperBoard | 10 | 9% | 80% | 11% | crack |
| Present Invention | 0 | 77% | 9% | 14% | no crack |
| Present Invention | 5 | 36% | 50% | 14% | no crack |
| Present Invention | 10 | 11% | 75% | 14% | slight cracked lines |

EXAMPLE 4

Figure 10:
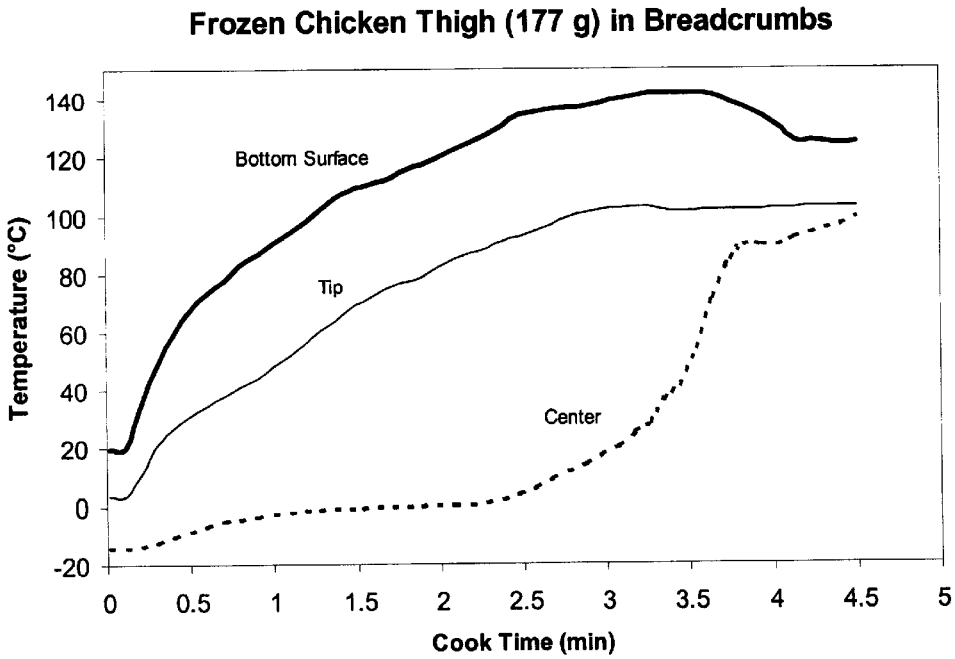
FIG. 10 is a graph showing temperature profiles of a piece of frozen chicken packaged in the abuse-tolerant material of the present invention as it is heated in a microwave oven.

FIG. 10 shows the temperature profiles of frozen chicken heated using sleeves of a patterned metallic segment/susceptor laminate according to the present invention. Three fiber-optic temperature probes were placed at different portions of frozen chicken to monitor the cooking temperature. The test results indicated that the patterned metallic segments included with a susceptor sleeve deliver a high surface temperature that causes good surface crisping of the chicken. Note that the center of the chicken heated after the surface and tip of the chicken were heated. This is close to the heating characteristics that would be observed in a conventional oven. The chicken cooked using microwave packaging according to the present invention achieved comparable results to a chicken cooked in a conventional oven. The chicken had a browned, crisped surface and the meat retained its juices.

EXAMPLE 5

A combined patterned metallic segment and susceptor lid according to the present invention as seen in FIG. 5 was used for microwave baking of a 28 oz. frozen fruit pie. It takes approximately 15 minutes in a 900 watt power output microwave oven to bake such a pie. The lid of this cooking package used the patterned metallic segment and susceptor sheet with periodical array of the basic structure as shown in FIGS. 4 and 5. Both the lid and tray are abuse-tolerant and safe for operation in a microwave oven. Testing showed this lid generated an even baking over the top surface. The lid can be exposed to an E-field strength as high as 15 kV/m unloaded by food without any risk of charring, arcing, or fire in the packaging or paper substrate tray.

EXAMPLE 6

In another experiment, the baking results for raw pizza dough using two kinds of reflective walls were compared.

Figure 6:
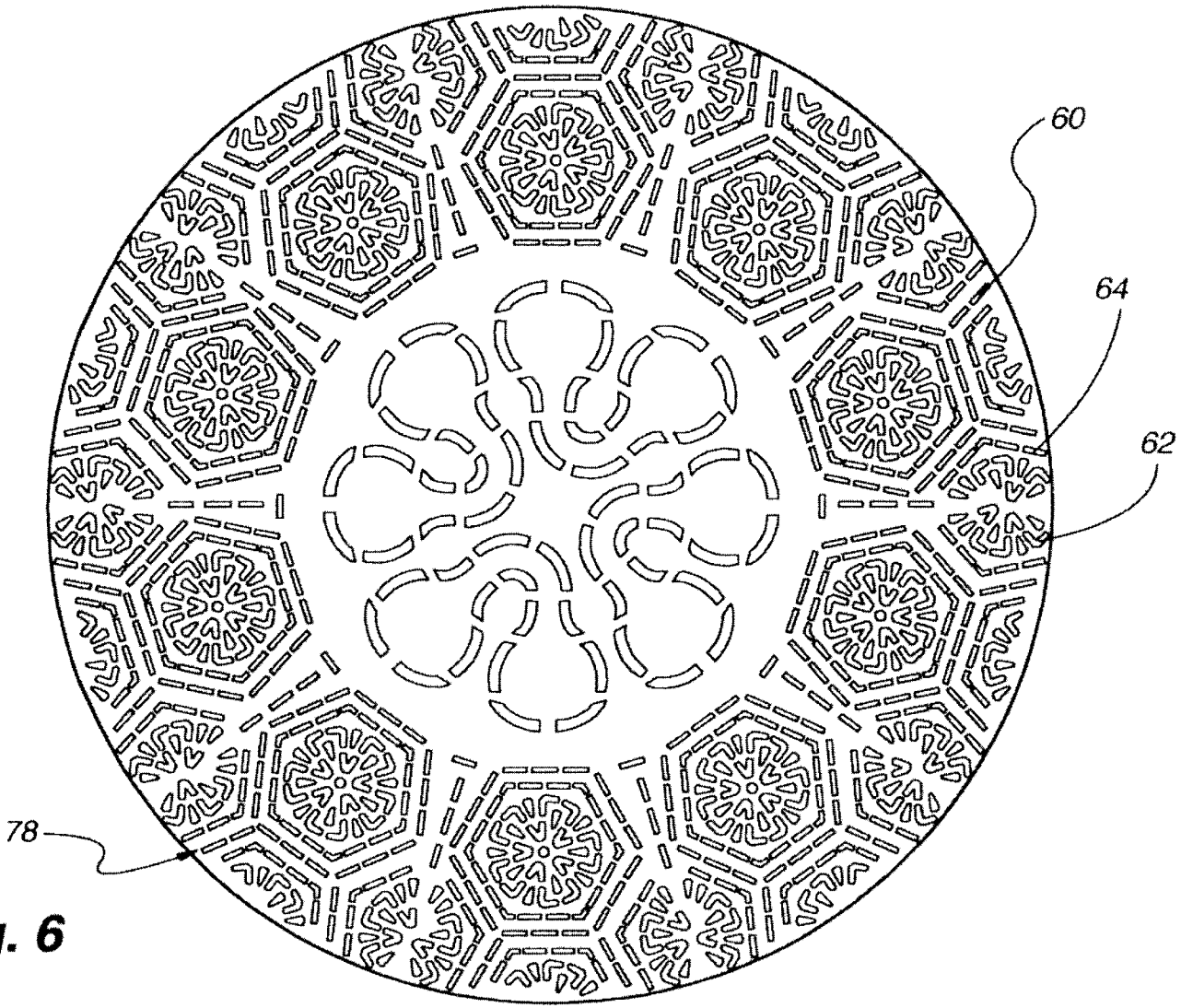
FIG. 6 is a plan view of a baking disk with a quasi-shielding wall according to a fourth embodiment of the present invention.

One wall was made with an aluminum foil sheet and the other was made from a packaging material according to the present invention. The quasi-shielding wall according to the present invention is shown in FIG. 6. A 7 $\mu$m thick aluminum foil was used in both wall structures (i.e., the metallic segments of the packaging material according to the present invention are 7 $\mu$m thick). Fairly similar baking performance was achieved in both pizzas. Thus the packaging material according to the present invention achieved the same good results as the less safe bulk foil.

The present invention can be used in several formats such as in baking lids, trays, and disks, with or without a laminated layer of susceptor film. In general, a susceptor laminated with the present invention is able to generate higher reflection of radiation power than a plain susceptor at the same level of input microwave power. The present invention can be treated as an effective quasi-shielding material for various microwave food-packaging applications.

The present invention has been described with reference to a preferred embodiment. However, it will be readily apparent to those skilled in the art that it is possible to embody the invention in specific forms other than as described above without departing from the spirit of the invention. The preferred embodiment is illustrative and should not be considered restrictive in any way. The scope of the invention is given by the appended claims, rather than the preceding description, and all variations and equivalents that fall within the range of the claims are intended to be embraced therein.

What is claimed is:

1. An abuse-tolerant microwave packaging material comprising:

a repeated first set of metallic segments on a substrate, wherein each first set of metallic segments defines a perimeter of a multi-lobe shape with a center, the perimeter having a length approximately equal to a predetermined fraction of an effective wavelength of microwaves in an operating microwave oven, and wherein each metallic segment in each first set of metallic segments is spaced apart from adjacent metallic segments; and a repeated second set of metallic segments on the substrate, wherein the metallic segments of each second set of metallic segments are arranged between and within the lobes of the multi-lobe shape defined by each first set of metallic segments, and wherein each metallic segment in each second set of metallic segments is spaced apart from adjacent segments of each first set of metallic segments.

2. An abuse-tolerant microwave packaging material as described in claim 1 wherein each metallic segment of each second set of metallic segments defines a triangular shape, and wherein a vertex of each triangular shape points toward the center of the multi-lobe shape defined by each first set of metallic segments.

3. The abuse-tolerant microwave packaging material of claim 1 wherein each metallic segment has an area less than 5 $mm^2$.

4. The abuse-tolerant microwave packaging material of claim 1 wherein the substrate includes a susceptor film.

5. The abuse-tolerant microwave packaging material of claim 1 wherein the substrate is microwave transparent.

6. The abuse-tolerant microwave packaging material of claim 5 wherein the substrate is a paper based material.

7. The abuse-tolerant microwave packaging material of claim 1 wherein the metallic segments are formed of metallic foil.

8. The abuse-tolerant microwave packaging material of claim 7 wherein the metallic foil comprises aluminum.

9. The abuse-tolerant microwave packaging material of claim 1 wherein the metallic segments are formed by the deposition of a high optical density evaporated material on the substrate.

10. The abuse-tolerant microwave packaging material of claim 9 wherein the high optical density evaporated material comprises aluminum.

11. The abuse-tolerant microwave packaging material of claim 1 wherein the predetermined fraction of the effective wavelength is an integer multiple of the effective wavelength, such that the length of the perimeter is resonant with the effective wavelength.

12. The abuse-tolerant microwave packaging material of claim 1 wherein the predetermined fraction of the effective wavelength is an integer multiple of one-half the effective wavelength, such that the length of the perimeter is quasi-resonant with the effective wavelength.

* * * * *

UNITED STATES PATENT AND TRADEMARK OFFICE

CERTIFICATE OF CORRECTION

PATENT NO. : 6,433,322 B2
DATED : August 13, 2002
INVENTOR(S) : Neilson Zeng et al.

It is certified that error appears in the above-identified patent and that said Letters Patent is hereby corrected as shown below:

Column 3,
Line 33, after “abuse-tolerant” insert -- microwave --;
Line 42, after “incorporating” insert -- a --; and
Line 56, after “the” delete “the” (second occurrence).

Column 9,
Line 61, delete “shwon” and insert -- shown --.

Signed and Sealed this

Fourth Day of February, 2003

JAMES E. ROGAN
*Director of the United States Patent and Trademark Office*